US008631600B2

(12) United States Patent
Atzl

(10) Patent No.: US 8,631,600 B2
(45) Date of Patent: Jan. 21, 2014

(54) RELEASING DEVICE

(76) Inventor: Andreas Atzl, Kufstein (AT)

( * ) Notice: Subject to any disclaimer, the term of this patent is extended or adjusted under 35 U.S.C. 154(b) by 490 days.

(21) Appl. No.: 12/911,152

(22) Filed: Oct. 25, 2010

(65) Prior Publication Data

US 2011/0094139 A1 Apr. 28, 2011

(30) Foreign Application Priority Data

Oct. 23, 2009 (AT) ..... A 1671/2009

(51) Int. Cl.
*F41A 19/00* (2006.01)

(52) U.S. Cl.
USPC ..... 42/69.01

(58) Field of Classification Search
USPC ..... 42/69.01–69.03; 89/27.11; 124/31, 32
See application file for complete search history.

(56) References Cited

U.S. PATENT DOCUMENTS

| | | | | | |
|---|---|---|---|---|---|
| 740,716 | A * | 10/1903 | Voller | ..... | 89/27.11 |
| 821,557 | A * | 5/1906 | Voller | ..... | 89/27.11 |
| 2,436,682 | A | 2/1948 | Weeks | | |
| 2,902,788 | A * | 9/1959 | Laager | ..... | 42/69.01 |
| 3,708,902 | A * | 1/1973 | Foster et al. | ..... | 42/106 |
| 3,726,040 | A * | 4/1973 | Cranston | ..... | 42/69.01 |
| 4,908,970 | A * | 3/1990 | Bell | ..... | 42/69.02 |
| 5,299,374 | A * | 4/1994 | Mathys | ..... | 42/69.01 |
| 5,458,046 | A | 10/1995 | Blenk et al. | | |
| 8,099,895 | B2 * | 1/2012 | Farley et al. | ..... | 42/69.03 |
| 2010/0175291 | A1 * | 7/2010 | Farley et al. | ..... | 42/69.01 |
| 2012/0131832 | A1 * | 5/2012 | Arduini | ..... | 42/69.01 |

FOREIGN PATENT DOCUMENTS

| | | |
|---|---|---|
| AT | 404878 | 2/1994 |
| WO | 8903013 | 4/1989 |

OTHER PUBLICATIONS

Drawing of a firearm (admitted prior art).

* cited by examiner

*Primary Examiner* — Jonathan C Weber
(74) *Attorney, Agent, or Firm* — Volpe and Koenig, P.C.

(57) ABSTRACT

A releasing device for a spring-loaded firing pin (1) or a spring-loaded firing-pin piece, in particular of a firearm, with at least one release trigger (2) that can be activated by hand, in particular, with at least one finger, and with a control body (3) acting on the firing pin (1) or the firing-pin piece. A transmission mechanism is arranged and/or acts between the release trigger (2) and the control body (1), and the transmission mechanism has a series of roller bodies (4) lying one on the other, advantageously balls and/or cylinders.

28 Claims, 6 Drawing Sheets

RELEASING DEVICE

CROSS-REFERENCE TO RELATED APPLICATIONS

This application claims the benefit of Austrian Patent Application No. A 1671/2009, filed Oct. 23, 2009, which is incorporated herein by reference as if fully set forth.

BACKGROUND a) Field of the Invention

The present invention relates to a releasing device for a spring-loaded firing pin or for a spring-loaded firing pin piece, in particular, of a firearm, with at least one release trigger that can be activated by hand, in particular, with at least one finger, and with a control body acting on the firing pin or on the firing-pin piece, wherein a transmission mechanism is arranged and/or acts between the release trigger and the control body.

b) Description of Related Prior Art

Releasing devices according to the class are used primarily for firearms. They are used to transmit a releasing movement triggered by hand, usually with one finger, so that the control body releases the firing pin or the firing-pin piece, so that this pin or piece, loaded by a striker spring, can accelerate forward and can release the shot by impacting directly on a cartridge or on a firing pin acting on the cartridge. For firearms, such releasing devices often interact with so-called bolt actions that have, among other things, the firing pin or the firing-pin piece and the firing pin, as well as the striker spring tensioning the firing pin or the firing-pin piece.

In order to be able to impact the firing pin sufficiently rigidly against the cartridge or the firing-pin piece sufficiently rigidly against the firing pin, the striker spring must be constructed with a corresponding strength. On the other hand, however, the resistance to be overcome by hand or with the finger in the releasing process should be as small as possible, so that the firearm does not crack during the releasing process or so that the shot does not miss its target. The resistance to be overcome during the releasing process is also designated as the trigger weight. It represents the force that must be applied on the release trigger, in order to release the firing pin or the firing-pin piece. Different requirements are placed on releasing devices according to the class. For example, as mentioned, the trigger weight should be as little as possible. However, it is also important that the releasing device can take place very quickly, so that the shot is then released when the shooter desires, so that it does not result in time delays that are too long between the trigger release and the shot.

In the prior art, for the transmission of the motion of the release trigger to the control body acting on the firing pin or the firing-pin piece, transmission mechanisms are used in the form of lever mechanisms that have, in part, complicated constructions. These usually have very complicated shapes and are thus expensive to produce.

SUMMARY

The object of the present invention is therefore to provide a releasing device according to the class that can be produced easily and nevertheless works precisely and can be realized, in particular, with a very low trigger weight.

To meet this objective, the present invention provides that the transmission mechanism has a series of roller bodies contacting each other, advantageously balls and/or cylinders.

Usually, the pressure of the striker spring contacting the firing pin or the firing-pin piece in the series provided according to the invention for roller bodies contacting each other is derived via the control body. Among other things, through the friction prevailing between the roller bodies, the force that is provided by the tensioned striker spring and usually lies in the range of 100 to 110 Newton, that is, 10 to 11 kg, can be reduced to a very low trigger weight. In preferred embodiments, it is possible to achieve trigger weights of 1 Newton or 100 grams and below with releasing devices constructed according to the invention. One special advantage of the releasing device according to the invention, however, is also the quickness with which the motion released by the release trigger can be transferred via the series of roller bodies and thus via the transmission mechanism constructed according to the invention to the control body and thus to the firing pin or the firing-pin piece. Despite these advantages, releasing devices according to the invention can be produced more easily due to their simpler structure and thus also more economically than the lever-transmission mechanisms known in the prior art. Another advantage of the invention lies in that releasing devices according to the invention could also be realized with very small spatial requirements, that is, can be realized in a small structural size.

For the sake of completeness, it is noted that the releasing devices according to the invention could be combined with very many different bolt actions for firearms known in the prior art. The control body could here act directly or also indirectly by via the intermediate connection of additional parts on the firing pin or the firing-pin piece. Releasing devices according to the invention, however, do not necessarily have to be used in firearms. If a releasing device for a firing pin or a firing-pin piece is also needed at another position, then this could be constructed according to the invention.

Favorably it is provided that the roller bodies forming the series are arranged on behind the other and each roller body contacts exactly two adjacent roller bodies, apart from the first and last roller bodies of the series.

Especially preferred embodiments of the invention provide that every two successive and/or contacting roller bodies of the series of roller bodies are arranged offset relative to each other. In this sense, the roller bodies of the series should not lie one behind each other exactly in a line, but instead should be arranged offset somewhat relative to each other especially viewed in the direction of the series with respect to its centers or center axes. Furthermore, it is preferable in the sense of the invention if the series of roller bodies is arranged in a transmission channel defined by channel walls. The distance of opposing channel walls should here be at least somewhat greater than the diameter of the roller bodies. Preferably, however, the distance of opposing channel walls is less than twice the diameter of each roller body. In this way it can be guaranteed that the roller bodies are arranged one behind the other, in particular, despite their offset. Preferably it is further provided that each roller body contacts at least one of the channel walls.

Through the offset of the roller bodies relative to each other, however, through their contact on at least one channel wall, the forces of the striker spring introduced via the control body onto the series of roller bodies are reduced in an especially good way, so that, overall, a very low trigger weight can be realized for the releasing device according to the invention. Preferably, it is provided here that the balls do indeed contact each other, the channel walls, and the control body, but otherwise move freely, that is, they are not also further connected to each other. In particular, in order to maintain or to specify the offset of the roller bodies relative to each other, preferred embodiments of the invention are provided such that at least one of the channels walls has at least one wall section projecting in the direction toward the channel interior, advantageous a series of alternating wall sections projecting in the direction toward the channel interior and recessed in the opposite direction.

In order to be able to transfer the motion of the release trigger generated by the activation by hand or with one finger to the series of roller bodies, especially preferred embodiments of the invention provide that at least one sub-area of at least one of the channel walls is constructed as a rocker that can pivot about at least one rocker pivoting axis. Here a locking piece could be arranged on the release trigger, wherein the rocker can be fixed in a first position and can be released in at least one released position. The rocker can be reset, in particular, in a releasing device released by the pressure of the striker spring, in that the rocker is spring-loaded from at least one rocker pull-back spring that is advantageously adjustable in its spring force, advantageously outside of the rocker pivoting axis.

As the roller bodies, e.g., balls and/or cylinders can be used. These should preferably be produced from a correspondingly hard material. For example, balls and/or cylinders made from metal, in particular, from steel, or from corresponding ceramic materials could be used.

BRIEF DESCRIPTION OF THE DRAWINGS

Additional details and features of preferred embodiments of the invention are described with reference to two embodiments of a releasing device according to the invention with reference to the accompanying figures.

Shown are.

DESCRIPTION OF THE PREFERRED EMBODIMENTS

Figure 1:
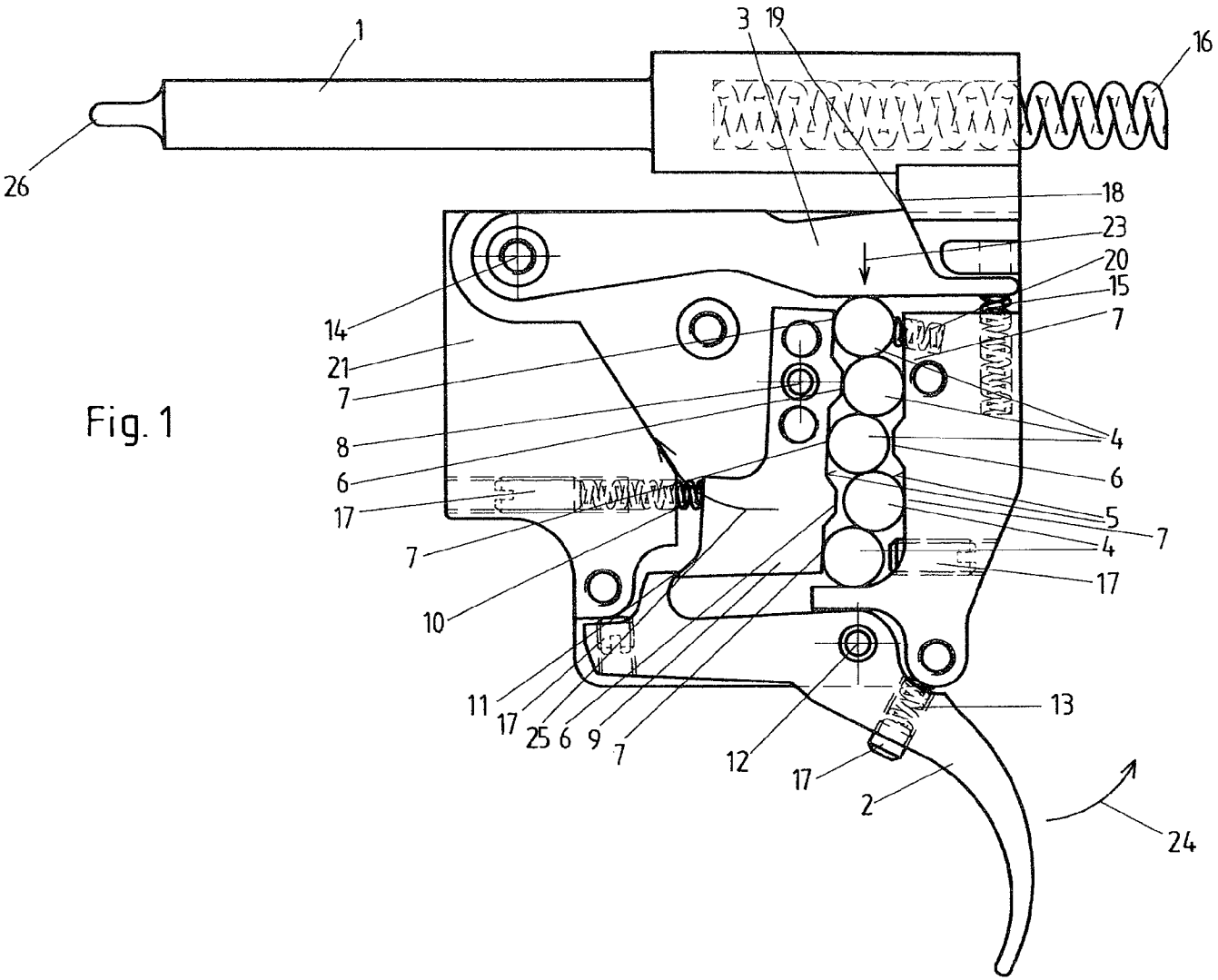
FIGS. 1 to 3 are views of a first embodiment according to the invention in different positions.
Figure 2:
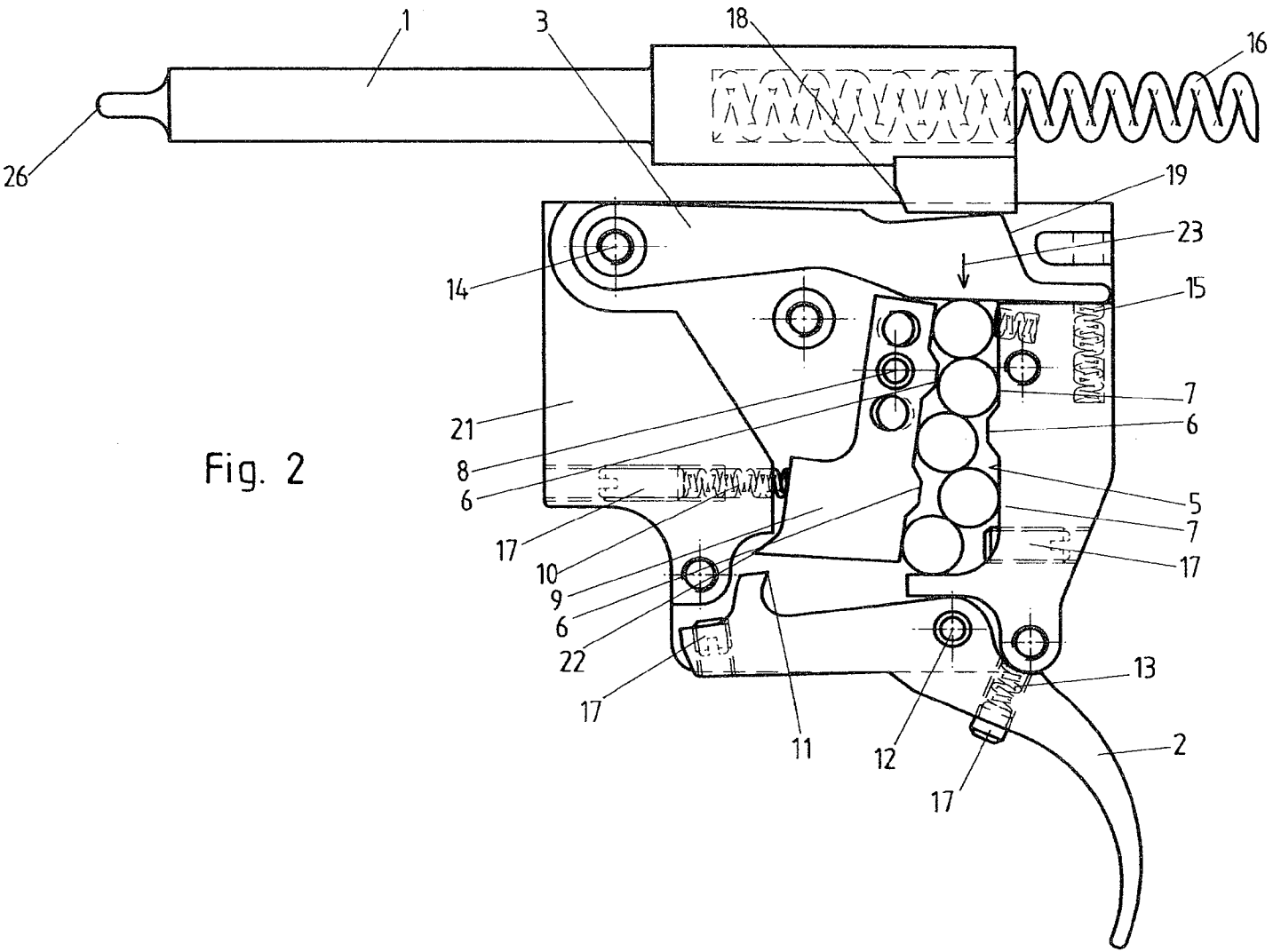
Figure 3:
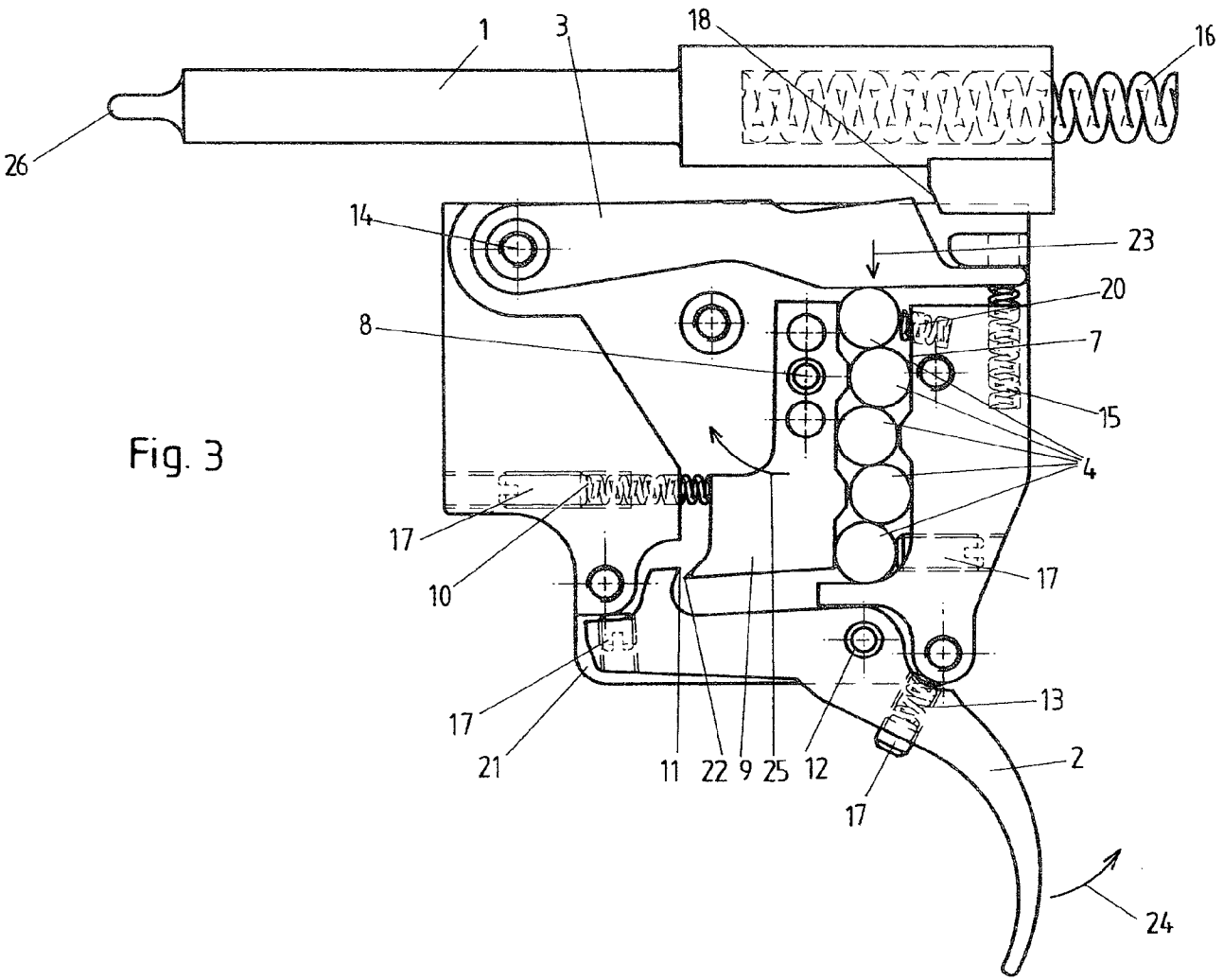

FIG. 1 shows the releasing device or the trigger of the first embodiment in a ready-to-fire position from which a shot can be released through activation of the release trigger 2 that is often also called a trigger blade. FIG. 2 shows the releasing device in the fired state in which the firing pin 1 is pushed by the striker spring 16 completely forward in the direction toward the cartridge not shown here. FIG. 3 shows the releasing device in a released state that is used for resetting the releasing device into the ready-to-fire position according to FIG. 1 as an intermediate step.

In the tensioned position according to FIG. 1, the striker spring 16 presses the firing pin 1 in the direction toward the cartridge not shown here, so that the firing pin 1 is biased accordingly. The bevel face 18 on the firing pin 1 is here supported on the bevel face 19 of the control body 3. Through the use of the bevel faces 18 and 19, the force of the striker spring 16 acting on the firing pin 1 is transmitted to the control body 3. This is here pressed in the pressing direction 23 against the uppermost roller body 4 that is here constructed as a ball like all of the other roller bodies. The control body 3, also called a stud, is constructed in the first embodiment as a lever that can pivot about the control-body pivoting axis 14. It is spring-loaded by a control-body pull-back spring 15 in the opposite direction relative to the direction 23. The pull-back spring 15, however, is significantly weaker than the forces of the striker spring 16 acting on the control body 3 via the bevel faces 18 and 19. The forces introduced in the direction 23 into the uppermost ball 4 are forwarded via the series of balls 4 and supported by the channel walls 5. Through the friction, the offset of the balls 4 relative to each other, and their support on the channel walls, the forces acting on the series of roller bodies or balls 4 are reduced. In order to specify the offset of the balls or roller bodies, the channel walls 5 do not have a flat construction, but instead have a series of alternating wall sections 6 projecting in the direction toward the channel interior and wall sections 7 recessed in the opposite direction. The uppermost ball 4 is also pressed in this embodiment by the alignment spring 20 in the direction toward the rocker 9. This measure is also used for guaranteeing that the balls 4 or their centers are always arranged offset relative to each other. With the adjusting screw 17 also provided in this embodiment, a fine adjustment of the motion clearance of the lowermost ball 4 can be performed.

In the illustrated embodiment, the front channel wall 5 pointing in the direction of the locking piece 11 is constructed as a rocker 9 that can pivot about the rocker pivoting axis 8. In the illustrated embodiment, the uppermost roller body 4 contacts the rocker 9 on one side of the rocker pivoting axis 8, while other roller bodies 4 contact the rocker 9 on the opposite side. Here, in the illustrated first embodiment, it is provided that more roller bodies 4 contact the rocker 9 on the side of the rocker pivoting axis 8 facing the release trigger 2 than on the opposing side of the rocker pivoting axis 8. The arrangement of roller bodies or of balls 4 on the one side but also on the other side of the rocker pivoting axis 8 further contributes to the result in this embodiment that the trigger weight, that is, the force with which the release trigger 2 must be activated is reduced.

In the illustrated embodiment, a locking piece 11 is arranged on the release trigger 2, wherein the rocker 9 can be held with this locking piece in the first tensioned position shown in FIG. 1. For this purpose, the rocker 9 has a counter locking piece 22 that interacts with the locking piece 11 on the release trigger 2 in the position according to FIG. 1. In addition, the rocker pull-back spring 10 also acts on the rocker 9. This spring is adjustable in the illustrated embodiment in its spring force, in that its biasing tension is set by the adjusting screw 17. This adjusting screw 17 is constructed in the form of a stud screw like all of the other adjusting screws 17 of this embodiment. The rocker pull-back spring is provided, as its name already suggests, primarily for pulling back the rocker 9 by pivoting about the rocker pivoting axis 8. By rotating on the adjusting screw 17 allocated to it, however, a fine adjustment of the trigger weight can also be performed.

In the illustrated embodiment, the release trigger 2 is also constructed as a lever that can pivot about a trigger pivoting axis 12. The trigger pivoting axis 12 is fixed to the housing 21 of the releasing device, like all of the other pivoting axes. In the illustrated embodiment, the trigger pull-back spring 13 is also arranged on the release trigger 2, wherein this spring biases the release trigger 2 in the direction toward the position shown in FIG. 1. In the first embodiment, this trigger pull-back spring 13 can also be adjusted by an adjusting screw 17 in its biasing tension or spring force. Here, a fine adjustment of the trigger weight could also be performed again. Another adjusting screw 17 is further provided on the release trigger 2 shown in FIGS. 1 to 3 on its locking-piece-side end, wherein adjustments can be made with this screw on how far the locking piece 11 and the counter locking piece 22 engage in each other in the tensioned state shown in FIG. 1.

Starting from the position shown in FIG. 1, now for releasing a shot, usually one finger is pressed against the release trigger 2 so that this trigger pivots in the direction 24 about the trigger pivoting axis 12. In this way, the locking piece 11 and also the counter locking piece 22 disengage. This has the result that the balls or roller bodies 4 tensioned by the striker spring 16 in the direction 23 fall or are pressed downward, that is, in the direction toward the release trigger 2, in that the rocker 9 pivots in the direction 25 about its rocker pivoting axis 8. In this way, the control body 3 or stud is, in turn, released, so that this can pivot in the direction 23 about its control-body pivoting axis 14, with which the bevel faces 18 and 19 come out of contact and the firing pin 1 is released, so that it can impact leading from the striker spring 16 with its integrally formed tip 26 onto the rear end or priming cap of the cartridge not shown here, with which the shot is released. Through the use of the series of roller bodies or balls 4 according to the invention, this releasing process can take place significantly more quickly than is possible with transmission mechanisms in the form of lever mechanisms in the prior art.

FIG. 2 shows the fired state of the releasing device according to the first embodiment. The locking piece 11 and counter locking piece 22 are not engaged. The rocker 9 is pivoted forward in the direction 25. The balls or roller bodies 4 have slid in the expanded channel downward in the direction toward the trigger pivoting axis 12. The control body 13 is pivoted downward in the direction 23, the striker pin 1 is released and pushed by the striker spring 16 to its maximum extent in the direction toward the not-shown cartridge.

In order to now be able to bring the releasing device of the first embodiment back into the tensioned state according to FIG. 1, in a known way, the firing pin 1 is pushed backward again by a part of the bolt action not shown in detail here, so that the striker spring 16 is compressed again. If the firing pin 1 is pushed backward far enough accordingly, as shown in FIG. 3, then the control body 3 is pivoted upward again against the direction 23 by the control-body pull-back spring 15. In this way, the balls or roller bodies 4 are released, so that the rocker pull-back spring 10 can pivot the rocker 9 back again and can constrict the channel in its lower region again. In this way, the balls or roller bodies 4 are pushed upward again, so that they reach their starting position according to FIG. 1. The trigger pull-back spring 13 can pivot the release trigger 2 back into the starting position again in the course of this motion against the direction 24. As a result of all of these resetting processes, the intermediate position according to FIG. 3 is reached. Now if the firing pin 1 is released again from a mechanism that is not shown here but is known in the bolt action of the firearm, then the striker spring 16 presses the first bevel face 18 back against the second bevel face 19, with which pressure is built up again on the roller bodies 4 in the direction 23. This has the result that the rocker 9 is pivoted again some distance in the direction 25 until the counter locking piece 22 engages with the locking piece 11 of the release trigger 2, with which the starting position according to FIG. 1 is reached again.

Figure 4:
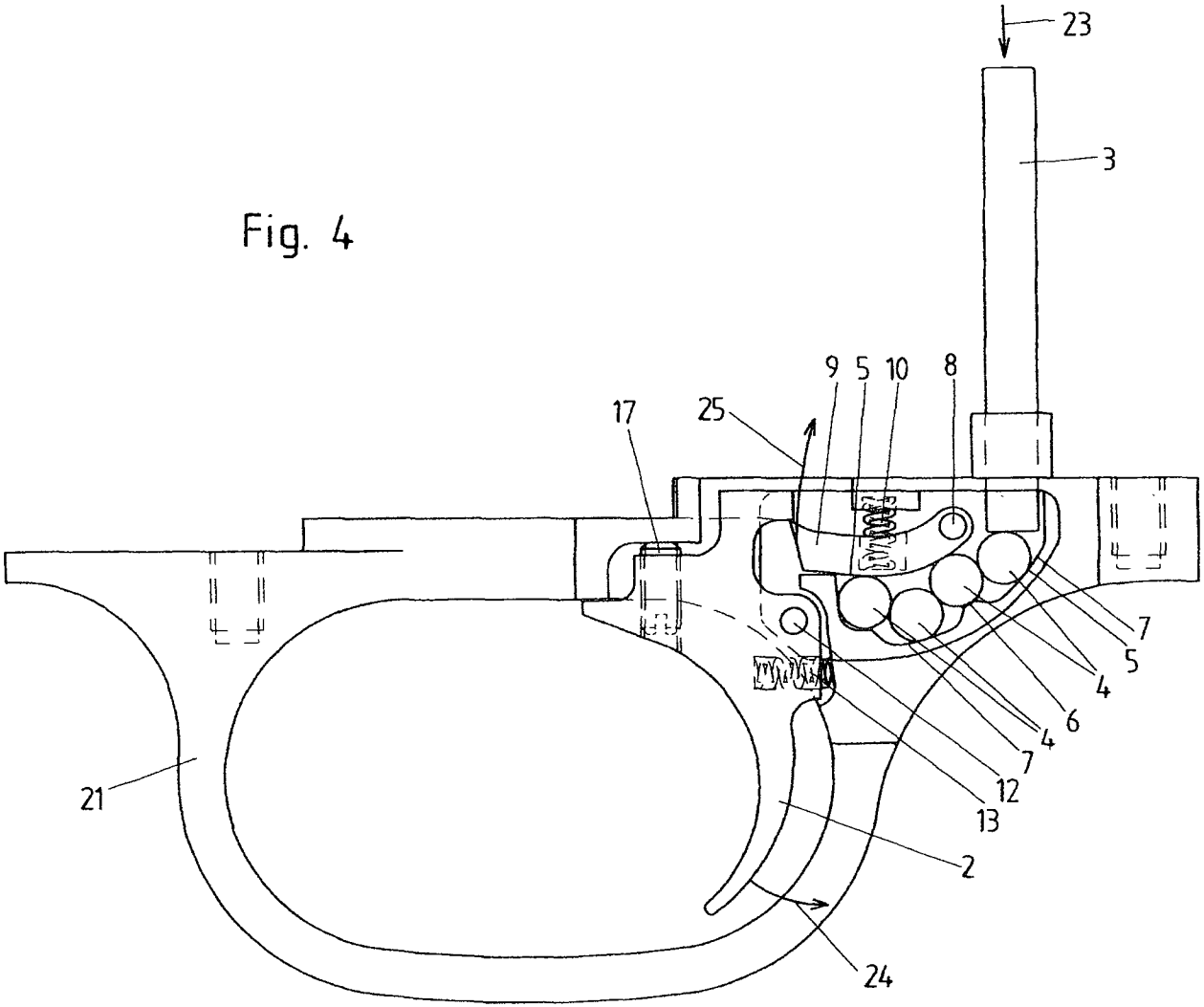
FIGS. 4 to 6 are views of a second embodiment according to the invention in different positions.
Figure 5:
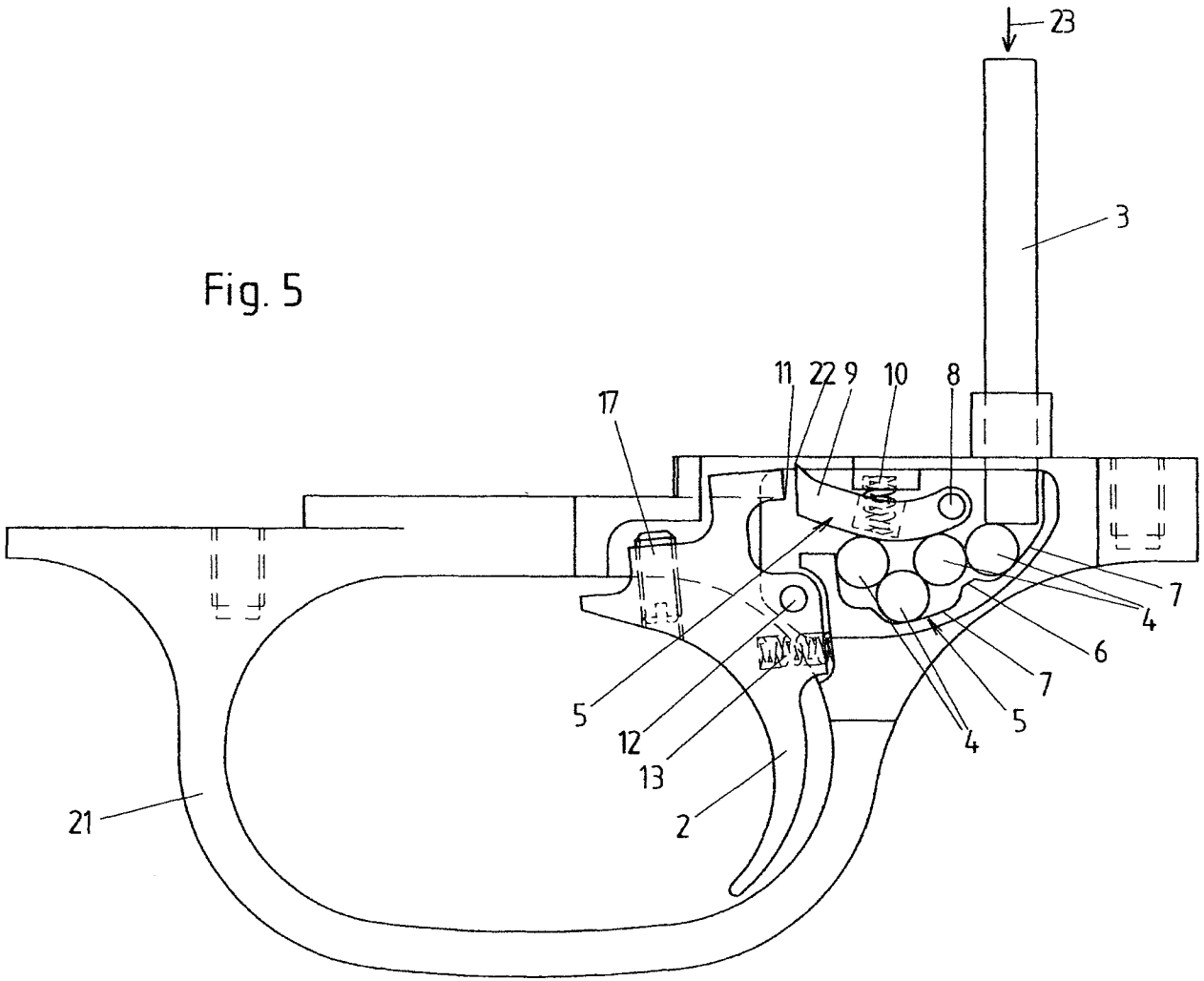
Figure 6:
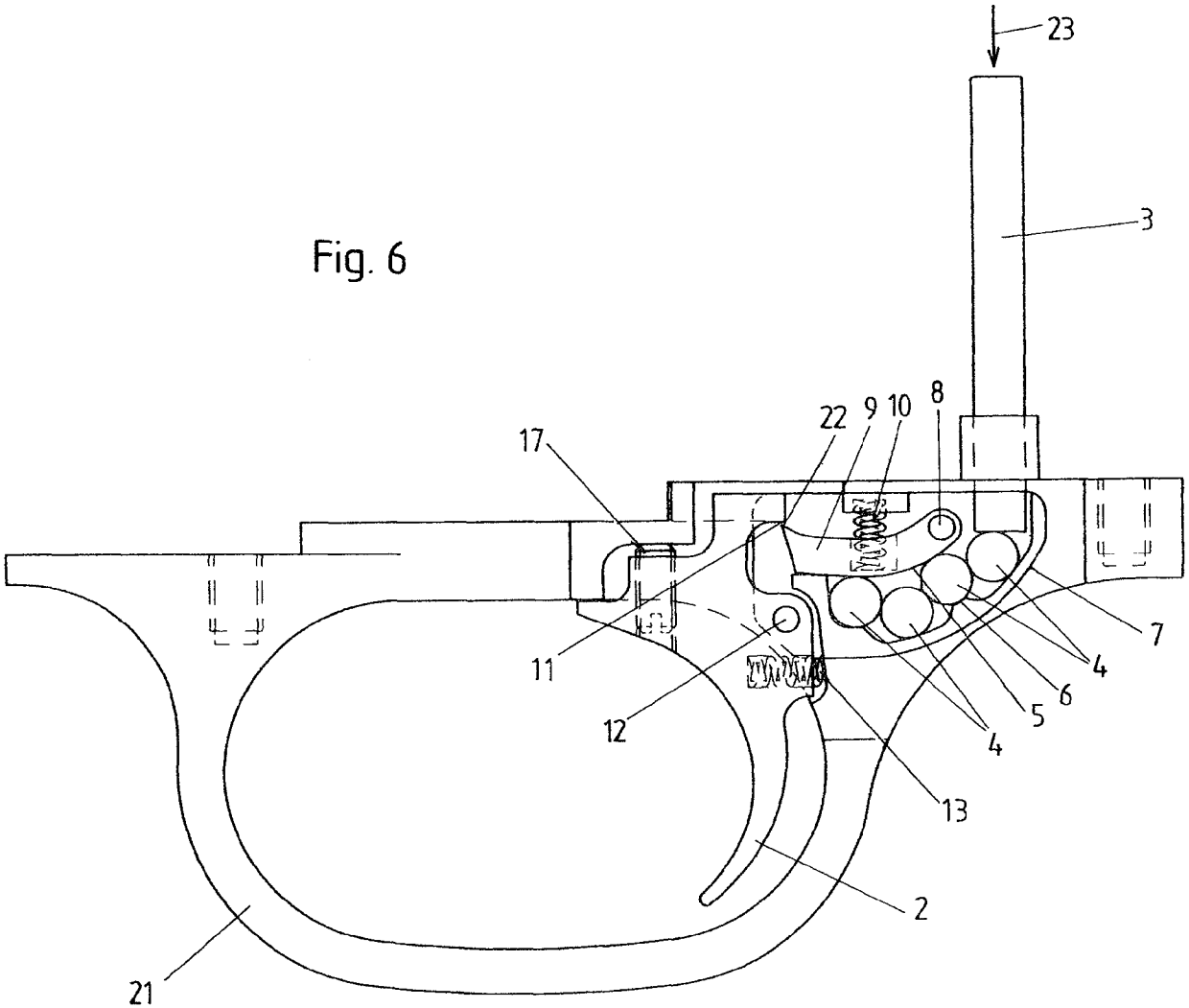

In the first embodiment according to FIGS. 1 to 3, the series of roller bodies or balls 4 and the channel holding them and limited by the channel walls 5 are oriented upright or, in the normal operating position, vertical. FIGS. 4 to 6 show a second embodiment in which the series of roller bodies or the balls 4 are oriented lying down, that is, in the shown normal operating position, essentially horizontal. The second embodiment shows that releasing devices according to the invention can have an especially space-saving or flat construction. The second embodiment is shown in FIG. 4 again in the tensioned, ready-to-fire state. FIG. 5 shows the fired state. FIG. 6 shows an intermediate position with which the releasing device can be brought again into the ready-to-fire state according to FIG. 4. The releasing device shown in the second embodiment is constructed especially for a so-called R93 bolt action by the company Blaser. This, however, is naturally only one example. Releasing devices according to the invention could be combined or adapted, as already stated, with or for nearly all known bolt actions of firearms. In the bolt-action type forming the basis of the second embodiment, the striker spring 16 not shown here acts in the direction 23 on the control body 3 so that this is pressed against the first of the balls 4 in the tensioned, ready-to-fire state according to FIG. 4. In the second embodiment, the friction between the roller bodies or balls 4, their offset arrangement, as well as their support on the channel walls 5 also provide for an optimal reduction of the trigger weight. In the second embodiment, a part of the channel wall 5 is also constructed as a rocker 9 that can pivot about the rocker axis 8 in the direction 25. The rocker 9 is held in the position according to FIG. 4, in turn, by the locking piece 11 until it is pressed against the release trigger 2 in the direction 24. If the release trigger 2 is pressed or pivoted in the direction 24, then the locking piece 11 releases the counter locking piece 22 and thus the rocker 9. This has the result, in turn, that the control body 3 constructed here as a pin that can be displaced in a linear motion is pressed in the direction 23 toward the trigger pivoting axis 12. This is possible in that the rocker 9 is pivoted in the direction 25, with which the channel holding the series of roller bodies 4 expands at its end directed toward the trigger pivoting axis 12. In this way, the control body 3 falls in the direction of the first ball 4 in the housing 21 of the releasing device, wherein the firing pin not shown here in this embodiment is released and is displaced by the striker spring 16 in the direction towards the similarly not-shown cartridge. This then releases the shot. FIG. 5 shows the fired state reached subsequent to this releasing process that takes place very quickly. Through the bolt action not shown here, the control body 3 can then be released again, wherein the pull-back springs 10 and 13 already mentioned with respect to the first embodiment can move the rocker 9 and the release trigger 2 back into the original position according to FIG. 4. The corresponding intermediate position is shown in FIG. 6. Now if the control body 3 is loaded back in the direction 23 by the bolt action, then the locking piece 11 and counter locking piece 22 engage with each other, in turn, wherein the read-to-fire or tensioned state according to FIG. 4 is reached again.

The actually illustrated embodiments 1 and 2 are variants selected only as examples. It is clear that the invention could be realized in many different forms. For example, instead of the balls used here, other roller bodies, such as, e.g., rollers or cylinders could also be used. The number of roller bodies and the orientation of their series could also be varied. For example, curved or bent arrangements of series of roller bodies or channels holding these bodies are also conceivable. The pull-back springs realized here in the form of coil springs could be replaced by other elastic bodies. Furthermore, according to the embodiment, each pull-back spring could be adjustable or even not adjustable in its spring force. Also, the firearms do not necessarily have to have firing pins that impact directly on the cartridge with their integrally formed tips. It is also possible to use releasing devices according to the invention for firearms in which a firing-pin piece is accelerated by the striker spring, and impacts a firing pin that therefore impacts the cartridge and releases the shot.

Releasing devices according to the invention can be combined or adapted, as already mentioned, with very different bolt actions. Primarily, however, it is noted again that releasing devices according to the invention could be used not only for firearms, but also for other applications in which a releasing device is needed for a firing pin or the like.

LEGEND TO THE REFERENCE SYMBOLS

1 Firing pin
2 Release trigger
3 Control body
4 Roller body
5 Channel wall
6 Projecting wall section
7 Recessed wall section
8 Rocker pivoting axis
9 Rocker
10 Rocker pull-back spring
11 Locking piece
12 Trigger pivoting axis
13 Trigger pull-back spring
14 Control-body pivoting axis
15 Control-body pull-back spring
16 Striker spring
17 Adjusting screw
18 First bevel face
19 Second bevel face
20 Alignment spring
21 Housing
22 Counter locking piece
23 Pressing direction
24 Pivoting direction
25 Pivoting direction
26 Tip

The invention claimed is:

1. A releasing device for a spring-loaded firing pin (1) or a spring-loaded firing-pin piece, comprising at least one release trigger (2) that can be activated by hand and a control body (3) acting on the firing pin (1) or the firing-pin piece, and a transmission mechanism acts between the release trigger (2) and the control body (3), and the transmission mechanism includes a series of roller bodies (4), wherein at least two of the roller bodies (4) are in direct contact with each other.

2. The releasing device according to claim 1, wherein every two successive ones of the roller bodies (4) in the series of roller bodies (4) are arranged offset relative to each other.

3. The releasing device according to claim 1, wherein the roller bodies (4) move freely within a transmission channel, the roller bodies free movement being limited within the transmission channel by channel walls (5) and the control body (3).

4. The releasing device according to claim 3, wherein each of the roller bodies (4) directly contacts at least one of the channel walls (5).

5. The releasing device according to claim 3, wherein at least one of the channel walls (5) has at least one wall section (6) projecting in a direction toward a channel interior.

6. The releasing device according to claim 3, wherein at least one of the channel walls (5) has a series of alternating walls sections (7) projecting in a direction toward a channel interior and recessed in an opposite direction.

7. The releasing device according to claim 3, wherein at least one sub-area of at least one of the channel walls (5) is constructed as a rocker (9) that can pivot about at least one rocker pivoting axis (8).

8. The releasing device according to claim 7, wherein the rocker (9) is spring loaded by at least one rocker pull-back spring (10).

9. The releasing device according to claim 8, wherein the rocker pull-back spring (10) has an adjustable spring force.

10. The releasing device according to claim 8, wherein the rocker (9) is spring-loaded by the rocker pull-back spring (10) outside of the rocker pivoting axis (8).

11. The releasing device according to claim 7, wherein at least one of the roller bodies (4) contacts the rocker (9) on one side of the rocker pivoting axis (8) and at least one of the other roller bodies (4) contacts the rocker (9) on an opposite side.

12. The releasing device according to claim 7, wherein more of the roller bodies (4) contact the rocker (9) on one side of the rocker pivoting axis (8) than on an opposite side of the rocker (9).

13. The releasing device according to claim 7, wherein more of the roller bodies (4) contact the rocker (9) on a side of the rocker pivoting axis (8) facing the release trigger (2) than on an opposite side of the rocker (9).

14. The releasing device according to claim 7, wherein a locking piece (11) is arranged on the release trigger (2), the rocker (9) can be fixed in a first position with the locking piece and can be released into at least one released position.

15. The releasing device according to claim 1, wherein the release trigger (2) is a lever that can pivot about a trigger pivoting axis (12).

16. The releasing device according to claim 15, wherein the release trigger (2) is spring-loaded by at least one trigger pull-back spring (13).

17. The releasing device according to claim 16, wherein trigger pull-back spring (13) has an adjustable spring force.

18. The releasing device according to claim 16, wherein the release trigger (2) is spring-loaded by the trigger pull-back spring (13) outside of the trigger pivoting axis (12).

19. The releasing device according to claim 1, wherein the control body (3) is a lever that can pivot about a control-body pivoting axis (14).

20. The releasing device according to claim 19, wherein the control body (3) is a lever spring-loaded by at least one control-body pull-back spring (15).

21. The releasing device according to claim 1, wherein the control body (3) is a pin that is displaceable in a linear motion.

22. The releasing device according to claim 1, wherein the control body (3) contacts at least one of the roller bodies (4).

23. The releasing device according to claim 1, wherein the releasing device is a releasing device for a spring-loaded firing pin (1) or a spring-loaded firing-pin piece of a firearm.

24. The releasing device according to claim 1, wherein the release trigger (2) is activatable with at least one finger.

25. The releasing device according to claim 1, wherein the transmission mechanism is arranged between the release trigger (2) and the control body (3).

26. The releasing device according to claim 1, wherein the roller bodies are balls.

27. The releasing device according to claim 1, wherein the roller bodies are rollers.

28. A firearm with a releasing device according to claim 1 for a spring-loaded firing pin (1) or a spring-loaded firing-pin piece of the firearm.

* * * * *